US006941783B2

(12) United States Patent
Yamanaka et al.

(10) Patent No.: US 6,941,783 B2
(45) Date of Patent: Sep. 13, 2005

(54) DOUBLE ACTION OIL HYDRAULIC PRESS

(75) Inventors: Shigeaki Yamanaka, Hiroshima (JP); Takeshi Kazama, Hiroshima (JP)

(73) Assignee: Kubota Iron Works Co., Ltd., Hiroshima (JP)

( * ) Notice: Subject to any disclaimer, the term of this patent is extended or adjusted under 35 U.S.C. 154(b) by 76 days.

(21) Appl. No.: 10/703,990

(22) Filed: Nov. 6, 2003

(65) Prior Publication Data

US 2004/0094048 A1 May 20, 2004

(30) Foreign Application Priority Data

Nov. 15, 2002 (JP) ..... 2002-331987

(51) Int. Cl.[7] ..... B21C 51/00; B30B 1/32

(52) U.S. Cl. ..... 72/17.2; 72/21.1; 72/21.5; 100/48; 100/99; 100/269.14

(58) Field of Search ..... 100/48, 264, 269.01, 100/269.06, 269.14, 99; 72/17.1, 17.2, 21.1, 21.5

(56) References Cited

U.S. PATENT DOCUMENTS

| | | | | |
|---|---|---|---|---|
| 5,031,431 A | * | 7/1991 | Naito | 72/21.5 |
| 5,823,104 A | * | 10/1998 | Beisel et al. | 100/48 |
| 6,379,119 B1 | | 4/2002 | Truninger | |
| 6,520,075 B1 | | 2/2003 | Shinoda et al. | |
| 6,634,205 B2 | * | 10/2003 | Yashima et al. | 72/443 |
| 2004/0033141 A1 | | 2/2004 | Stillhard et al. | |

FOREIGN PATENT DOCUMENTS

| | | |
|---|---|---|
| JP | 62-009799 | 1/1987 |
| JP | 05-104299 | 4/1993 |
| JP | 2000-265966 | 9/2000 |
| JP | 2001-105187 A | 4/2001 |
| JP | 2002-2066799 | 3/2002 |
| WO | WO 01/81027 A1 | 11/2001 |

* cited by examiner

*Primary Examiner*—Lowell A. Larson
*Assistant Examiner*—Jimmy Nguyen
(74) *Attorney, Agent, or Firm*—Frishauf, Holtz, Goodman & Chick, P.C.

(57) ABSTRACT

A double action oil hydraulic press is provided having a main cylinder for actuating a slide and a lower part forming cylinder for actuating a lower part forming unit, wherein the operations of the cylinders are controlled through the combined control of the rotation of an oil hydraulic pump of a power unit and servo valves whereby the amount of operation oil that must be used is reduced. To this end, the press comprises a power unit comprising a variable displacement oil hydraulic pump adapted to be driven by an inverter motor; controllable servo valves provided in hydraulic circuits connecting the power unit to the main cylinder and to the lower part forming cylinder, respectively; servo controllers for controlling the servo valves, respectively; cylinder pressure detecting sensors provided in the hydraulic circuits, respectively; position detecting sensors for sensing positions of the slide and the lower part forming unit, respectively; a control unit for furnishing the inverter motor of the power unit and the servo controllers with control signals, respectively, and means whereby respective sensing signals of the cylinder pressure and position detecting sensors are fed back to the control unit.

2 Claims, 9 Drawing Sheets

DOUBLE ACTION OIL HYDRAULIC PRESS

BACKGROUND OF THE INVENTION

1. Field of the Invention

The present invention relates to a multiaxial double action oil hydraulic press having at least one upper press unit movable downwards and at least one lower press unit movable upwards, the press also having an upthrust lifting unit.

2. Description of the Prior Art

A double action oil hydraulic press having two pressing units made of an outer and an inner slide, respectively, has been known from JP 2001-105187.

The outer slide of this conventional double action oil hydraulic press is driven by an outer slide driving cylinder which is connected to a variable displacement oil hydraulic pump via an oil hydraulic circuit provided with a relief valve in its midway. The outer slide is actuated with the pressure oil from the variable displacement oil hydraulic pump, whose flow rate is controlled by an outer slide control unit.

The conventional double action oil hydraulic press is operable 3- or 5-axially with three or five pressing units each of which is operated by a single cylinder, and requires a large oil hydraulic reservoir. Typically, for example, a reservoir of 2000 liters in capacity is required for a 600 ton press, which inconveniently makes the entire press large-sized. Further inconveniences of the conventional press are that it is slow in pressing speed and thus low in productivity, and is also low in the accuracy with which the slide is brought to halt and which has so far been limited to 0.1 mm at best.

BRIEF SUMMARY OF THE INVENTION

With the forgoing taken into account, the present invention has an object aimed at providing an improved double action oil hydraulic press in which the operations of a plurality of cylinders such as a slide cylinder and a knockout cylinder can be controlled with an increased precision while the total amount of operating oil that must be used in the oil hydraulic press can be reduced and hence the reservoir can be reduced in capacity.

In order to achieve the object mentioned above there is provided in accordance with the present invention a double action oil hydraulic press having a main cylinder for actuating a slide and a lower part forming cylinder for actuating a lower part forming unit, characterized in that it comprises: a power unit comprising a variable displacement oil hydraulic pump adapted to be driven by an inverter motor; controllable servo valves provided in hydraulic circuits connecting the power unit to the main cylinder and to the lower part forming cylinder, respectively; servo controllers for controlling the controllable servo valves, respectively; cylinder pressure detecting sensors provided in the hydraulic circuits, respectively; position detecting sensors for sensing positions of the slide and the lower part forming unit, respectively; a control unit for furnishing the inverter motor in the power unit and the servo controllers with control signals, respectively, and means whereby respective sensing signals of the cylinder pressure and position detecting sensors are fed back to the control unit.

The present invention also provides a double action oil hydraulic press having a main cylinder for actuating a slide, an inner and an outer cylinder provided in the slide and a lower part forming cylinder for actuating a lower part forming unit, characterized in that it comprises: a power unit comprising a variable displacement oil hydraulic pump adapted to be driven by an inverter motor; controllable servo valves provided in hydraulic circuits connecting the power unit to the said main cylinder and to the lower part forming cylinder, respectively; servo controllers for controlling the controllable servo valves, respectively; controllable proportional valves provided in hydraulic circuits connecting the power unit to the said inner cylinder and to the outer cylinder, respectively; proportional valve controllers for controlling the said controllable proportional valves; cylinder pressure detecting sensors provided in the hydraulic circuits, respectively; position detecting sensors for sensing positions of the slide and the lower part forming unit, respectively; a control unit for furnishing the inverter motor in the power unit, the servo controllers and the proportional valve controllers with control signals, respectively, and means whereby respective sensing signals of the cylinder pressure and position detecting sensors are fed back to the control unit.

Piston movements in the cylinders in the double action oil hydraulic press are controlled by both the controlled speed of rotation of the oil hydraulic pump in the power unit and the controlled operations of the controllable servo valves and proportional valves to determine their positions and the lower dead point of the slide and in an unload state, to reduce the pump's discharge to an extent that does not hinder the pump's lubrication.

The main cylinder is supplied with oil at a flow rate that is determined by a rate of rotation of the pump controlled so that the pressure exerting slide is moved down at a controlled rate. And, the final positioning of the slide to halt is controlled jointly with a servo valve which controls the flow rate of pressure oil supplied from the power unit.

BRIEF DESCRIPTION OF THE DRAWINGS

These and other objects, features and advantages of the present invention and other manners of its implementation will be more readily apparent, and the invention itself will also be better understood, from the following detailed description when taken with reference to the drawings attached hereto showing certain illustrative forms of implementation of the present invention. In the drawings.

DETAILED DESCRIPTION

Figure 1:
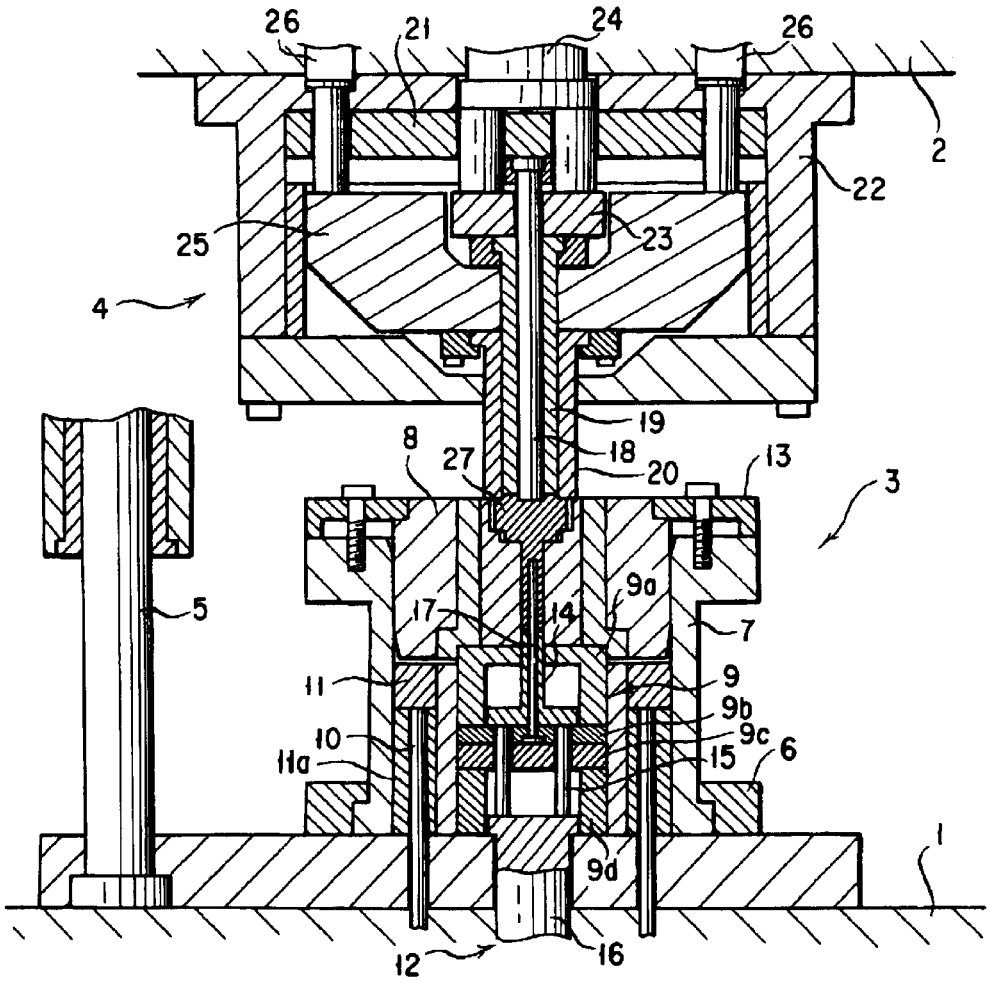
FIG. 1 is a cross sectional view illustrating a double action oil hydraulic press according to the present invention.

An explanation is now given of one form of implementation of the present invention with reference to the Drawing Figures. FIG. 1 is a cross sectional view illustrating forming press sections in a double action oil hydraulic press to which the present invention is applied. Shown in FIG. 1 are a bolster 1, a slide 2, a lower die unit 3 securely connected to the upper surface of the bolster 1, an upper die unit 4 securely connected to the lower surface of the slide 2, and a guide post 5 for guiding the upper die unit 4 vertically up and down relative to the lower die unit 3.

The lower die unit 3 as shown comprises a die holder 7 fastened to the bolster 1 by means of a fastening member 6, a lower die 8 received in the die holder 7 slidably up an down to be tight-fitted therein, a set pedestal 9 for setting the lower die 8 at a predetermined height in the die holder 7, a lifting plate 11 supported on a stand 11*a* to lie opposed to the lower surface of the lower die 8, a lower part forming unit 12 disposed inside of the set pedestal 9 beneath the lower die 8 and which closes the lower side of a die cavity of the lower die 8, and a clamp means 13 for clamping the lower die 8 to the die holder 7. The lifting plate 11 is adapted here to be raised by lifting rods 10. The clamp means 13 may comprise a plurality of clamp members disposed at a plurality of locations, respectively, circumferentially of the die holder 7. The set pedestal 9 as shown is made of a ring plate 9*a*, a mandrel plate 9*b*, a plain plate 9*c* and a ring plate 9*d*. To clamp the lower die 8 and the die holder 7 together, the clamp means 13 may be actuated manually or by means of an oil hydraulic cylinder or any other known suitable means.

Figure 2:
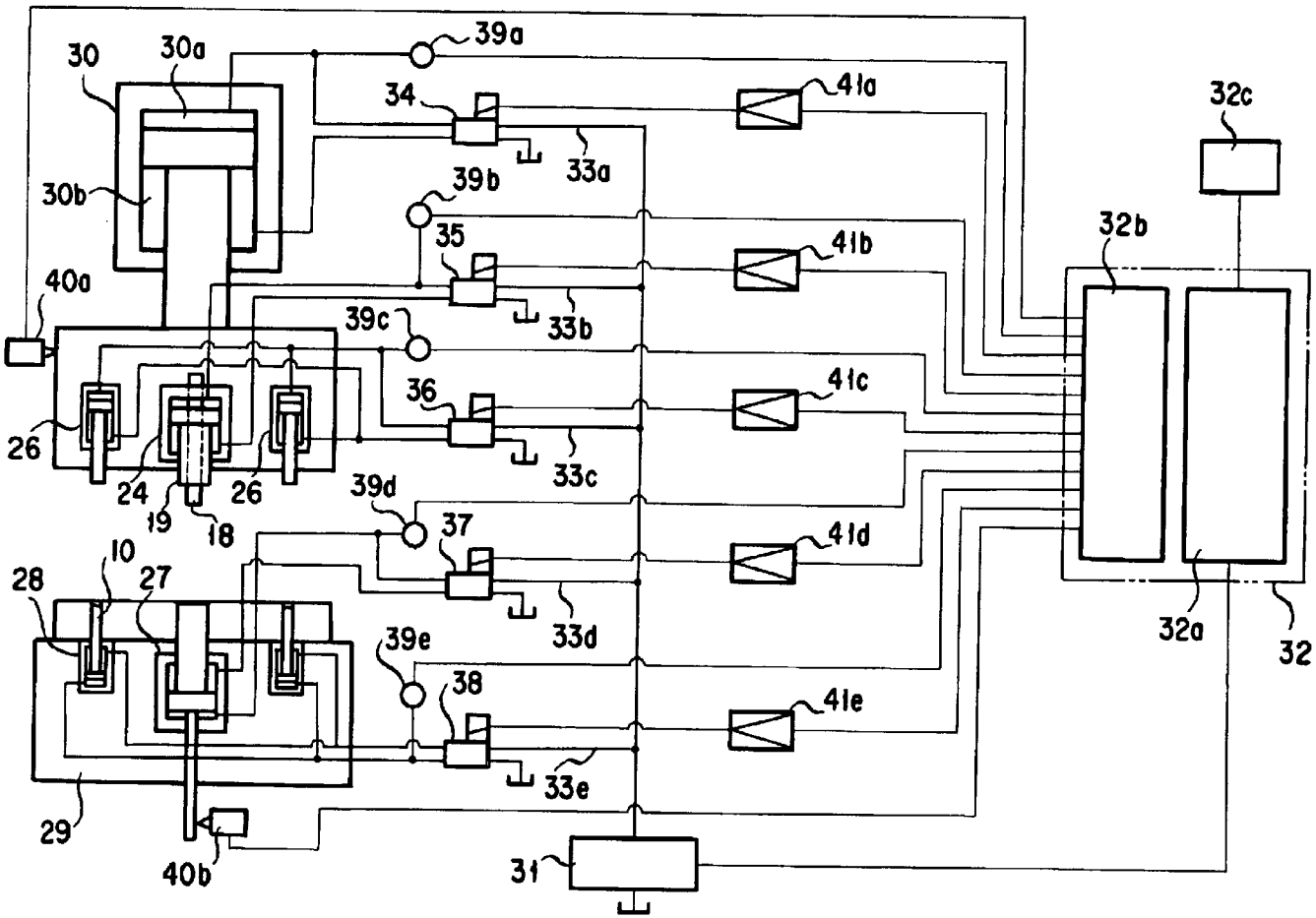
FIG. 2 is a circuit diagram illustrating the double action oil hydraulic press of the present invention.

A said lifting rod 10 is operatively coupled to a lift cylinder 28 shown in FIG. 2. The lower part forming unit 12 comprises a lower part forming die 14 inserted through a lower part of the die cavity of the lower die 8 in a slide fit therewith and supported by the set pedestal 9, and a hollow part forming pin 17 that passes through the lower part forming die 14, wherein the lower part forming die 14 is adapted to be lifted up and down by a lower part forming cylinder 27 (shown in FIG. 2) with the intermediary of rods 15 and a lower supporting block 16 and the hollow part forming pin 17 is supported from the set pedestal 9.

The lower die 8 is formed in a multi-layer structure made of a plurality of die members together so that if a lower member in its inside in which the die cavity is formed is worn thin, the same can be replaced for.

The upper die unit 4 includes a main punch 18 formed in the shape of a shaft, an inner punch 19 formed in the shape of a cylinder such as to surround the main punch 18, and an outer punch 20 formed in the shape of a cylinder such as to surround the inner punch 19. These punches 18, 19 and 20 are slidably fitted one in another. Further, the main punch 18 is united with the slide 2 via a plate 21 and a frame member 22, the inner punch 19 is coupled via an intermediate member 23 to a piston rod of an inner cylinder 24 provided for the slide 2, and the outer punch 20 is coupled via another intermediate member 25 to respective piston rods of outer cylinders 26 and 26 for the slide 2 parallel to the inner cylinder 24.

FIG. 2 shows an oil hydraulic circuit for cylinders to drive various operating parts in the double action oil hydraulic press constructed as mentioned above. These cylinders include the lower part forming cylinder 27 for the lower part forming unit 12 and the lift cylinder 28 for driving the lifting rod 10 which cylinders are provided in a bed 29, a main cylinder 30 for lifting the slide 2 up and down, the inner cylinder 24 provided in a center region of the slide 2, and the outer cylinders 26 and 26 provided at both sides of the inner cylinder 24. Including these five types of cylinders, this double action oil hydraulic press is therefore a five-axis double action oil hydraulic press.

These cylinders are fed with pressure oil from a power unit 31 which is designed to have its pressure oil discharge controlled by a command from a control board 32*a* in a control unit 32. The main cylinder 30, the inner cylinder 24, the outer cylinders 26 and 26, the lower part forming cylinder 27 and the lift cylinder 28 are connected parallel to one another to the power unit 31 via oil hydraulic circuit lines 33*a*, 33*b*, 33*c*, 33*d* and 33*e*, respectively.

The main cylinder, the inner cylinder, the outer cylinder, the lower part forming cylinder and the lift cylinder oil hydraulic circuit lines 33*a*, 33*b*, 33*c*, 33*d* and 33*e* are provided with a main cylinder control servo valve 34, an inner cylinder control proportional valve 35, an outer cylinder control proportional valve 36, a lower part forming cylinder control servo valve 37 and a lift cylinder control proportional valve 38, respectively. These cylinders are provided at their operating sides with pressure detecting sensors 39*a*, 39*b*, 39*c*, 39*d* and 39*e*, respectively, such that their detected values are each furnished as a feedback signal to a CPU 32*b* in the control unit 32.

Further, a slide position detector 40*a* and a lower part forming cylinder position detector 40*b* are provided for the slide 2 actuated by the main cylinder 30 and for the lower supporting block 16 opposed thereto, respectively, so that their detected values are each furnished as a feedback signal to the CPU 32*b* in the control unit 32.

Also provided are a main cylinder servo controller 41*a* responsive to a signal from the CPU 32*b* for controlling the operation of the main cylinder control servo valve 34, an inner cylinder proportional valve controller 41*b* for controlling the inner cylinder control proportional valve 35, an outer cylinder proportional valve controller 41*c* for controlling the outer cylinder control proportional valve 36, a lower part forming cylinder servo controller 41*d* for controlling the lower part forming cylinder control servo valve 37 and a lift cylinder proportional valve controller 41*e* for controlling the lift cylinder control proportional valve 38.

In the makeup mentioned above, the cylinders are concurrently fed with pressure oil from the power unit 31 whose discharge flows are controlled by the control unit 32, which are in turn controlled by the cylinder control servo valves 34 and 37 and the cylinder control proportional valves 35, 26 and 38 provided for the oil hydraulic circuit lines 33*a* to 33*e*, respectively, so as to actuate the respective cylinders. And, the respective operations of the cylinders are controlled as the respective valves 34 to 38 are controlled by controllers 41*a* to 41*e* rendered operable in response to control input signal from the control unit 32.

The control unit 32 is then fed back from the pressure detecting sensors 39*a* to 39*d* with pressure signals representing operating pressures P1 to P4 in the cylinders, respectively, and from the position detectors 40*a* and 40*b* with position signals representing the positions of the main cylinder 30 and the lower part forming cylinder 27, respectively, and these feedback signals to the control unit 32 are used to correct its output signals to the controllers 41*a* to 41*e*. It is configured and established at the control panel 32*c* how signals as mentioned above are issued from the control unit 32.

Figure 3:
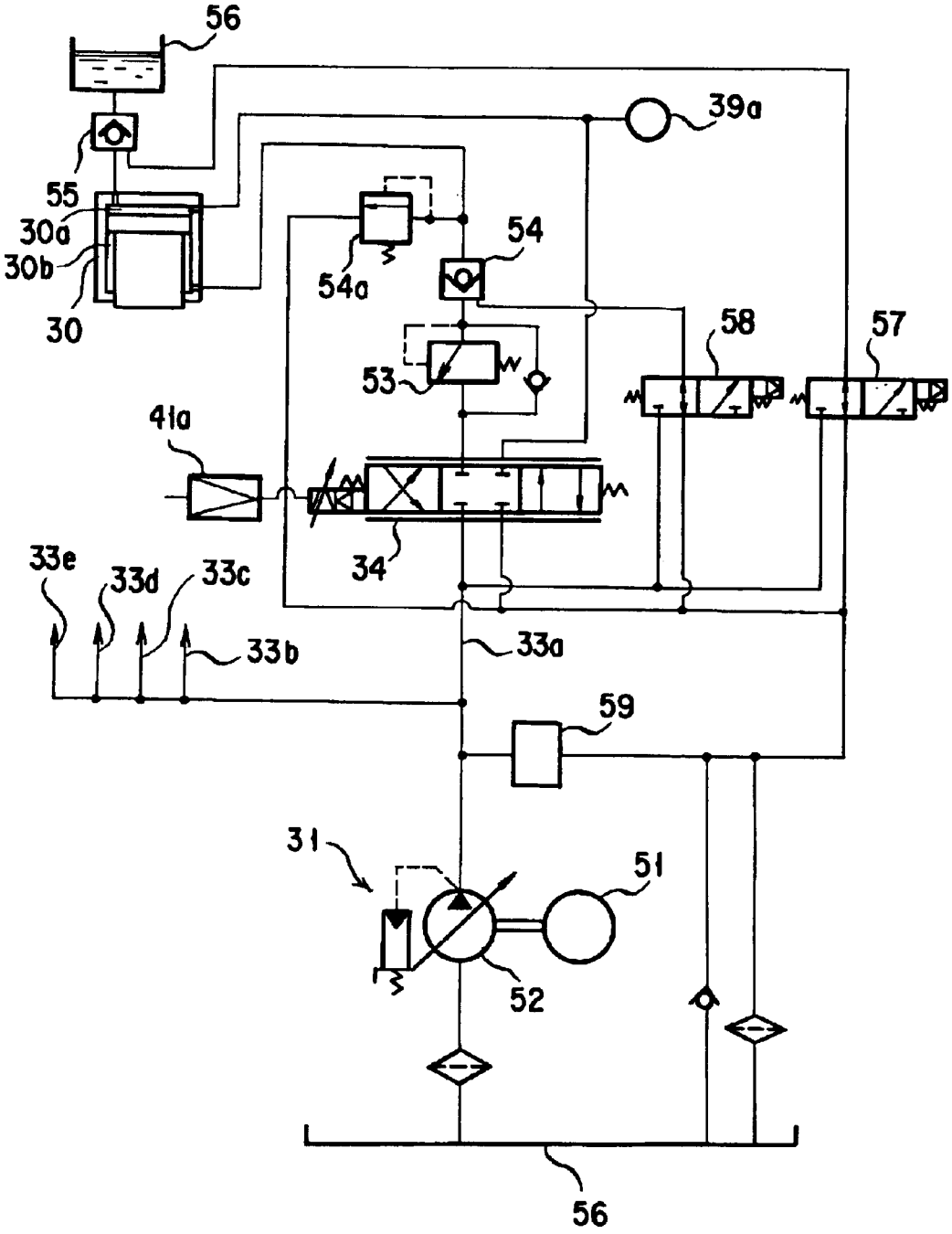
FIG. 3 is a circuit diagram illustrating a specific example of a principal part of a oil hydraulic control unit shown in FIG. 2.

FIG. 3 shows a specific makeup of one of the various oil hydraulic circuits mentioned above, e.g., that in connection with the oil hydraulic circuit line 33*a* for the main cylinder 30. The power unit 31 here comprises an inverter motor 51 whose driving operation is controlled at the control unit 32, and a variable displacement oil hydraulic pump 52 adapted to be driven by the inverter motor 51. This power unit 31 is designed to feed pressure oil into the main cylinder 30 through the main cylinder control servo valve 34. Provided between the main cylinder control servo valve 34 and a lower oil chamber 30*b* of the main cylinder 30 are a counterbalance valve 53 to impart a back pressure to the main cylinder 30 during its down stroke and a pilot check valve 54. A relief valve 54*a* is provided between an upstream side of the pilot check valve 54 and a reservoir 56. The reservoir 56 is connected to an upper oil chamber 30*a* of the main cylinder 30 via a prefill valve 55 made up of a pilot check valve.

There are also included pilot pressure switching valves 57 and 58 for applying a pilot pressure to the pilot check valve 54 and the prefill valve 55 to selectively open them in response to a signal from the control unit 32. There is further provided a pump safety valve 59.

In FIG. 3, instructions as needed are supplied from the control unit 32 to the pilot switching valves 57 and 58, the prefill valve 55, the pilot check valve 54, the counterbalance valve 53, the servo controller 41*a,* the servo valve 34, the pump safety valve 59, the oil hydraulic pump 52 and the inverter motor 51 to effect positioning and controlling the pressure and velocity for the main cylinder 30.

In a press forming operation, the main cylinder 30 first causes the slide 2 to commence descending from its upper dead point (action start position). Then, the pilot check valve 54 is opened to open the counterbalance valve 53 in order to prevent a back pressure from acting on the main cylinder 30. The servo valve 34 is switched to its descending side, and the inverter motor 51 is rotated at a maximum number of rotations to cause the oil hydraulic pump 52 to discharge pressure oil at a maximum flow rate, while the prefill valve 55 connected to the upper oil chamber 30*a* of the main cylinder 30 is opened to bring it into a self-feeding state. The slide 2 is thereby rapidly fed until it reaches its forming start position.

Then, when the state is reached that a forming load is acting on the main cylinder 30 via the slide 2, namely when in the forming start state, the pilot check valve 54 is closed to close the counterbalance valve 53 in order to cause a back pressure to act on the main cylinder 30. The prefill valve 55 is closed to cause the slide 2 to descend by the main cylinder 30 at a descending rate of forming under pressure while reducing the required feed rate of pressure oil. Then, the operating oil from the lower oil chamber in the main cylinder 30 is drained through the relief valve 54*a*. Also, since the operating oil then becomes smaller in flow, the discharge flow of pressure oil from the variable displacement oil hydraulic pump 52 is held down to small.

With the progress of forming, when the slide reaches its preestablished lower dead point (forming end point), this is detected by the position detector 40 whereby the discharge flow of the pump 52 is controlled through the control by the control unit 32 of the number of rotations of the inverter motor 51 and the servo valve 34 so that the slide 2 comes to stop at the pre-established lower dead point accurately (with an inaccuracy as low as 0.05 mm or less).

The pressing pressure then is monitored by the pressure sensor 39*a* in terms of the main cylinder's thrust and controlled by the servo valve 34 so that it is held at its preestablished level. After the forming is completed, the servo valve 34 is switched to its ascending side, and the oil hydraulic pump 52 has its number of rotations increased to a preestablished maximum level to cause the main cylinder 30 to produce a rapid ascending movement. Then, the oil in the upper oil chamber 30*a* in the main cylinder 30 may be drained directly into the reservoir 56 by opening the prefill valve 55.

Also, in an unload state the pump's safety valve 59 is turned to its unload state and the pump's number of rotations is decreased to a minimum level to reduce the flow rate of the operating oil, thereby limiting the rise of the oil temperature so that the energy required to drive the motor may be reduced.

In this manner, the variable displacement oil hydraulic pump 52 has its discharge pressure in two steps which can be switched from one to the other corresponding to the rapid descending and ascending speed and the forming speed of the slide 2.

Also, since the flow of the operating oil supplied into each cylinder can be controlled by the corresponding servo valve or proportional valve, the discharge flow of the variable displacement pump 52 during the forming can be reduced corresponding to the flow of the oil then supplied to a given cylinder. Moreover, the operating oil is then prevented from draining in a large amount through the relief valve. Also, since the total amount of the operating oil required can correspondingly be reduced, the capacity of the reservoir can be reduced. Further, since the heat generation of the operating oil can be held down, it is possible to reduce the energy loss.

Figure 4:
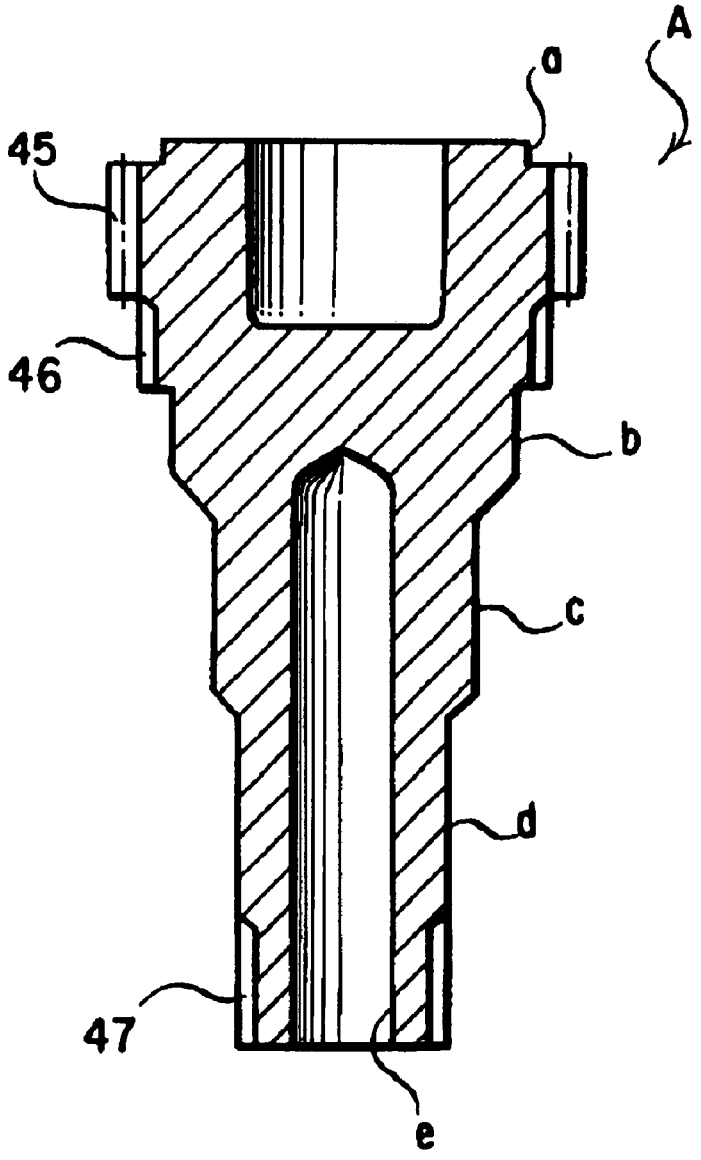
FIG. 4 is a cross sectional view illustrating a stepped shaft to be formed by the press of the present invention.

Mention is next made of one form of implementation of the invention applied to the making of a stepped shaft A as shown in FIG. 4 using a 5-axis operated double action oil hydraulic press of the makeup mentioned above.

The stepped shaft A comprises a first, a second, a third and a fourth step region a, b, c and d made smaller successively in diameter longitudinally. In the shaft A, the first step region a which at its base end side is the largest in diameter is provided with a gear 45 and a first spline 46 while the fourth step region d located at its tip end side is provide with a second spline 47, and the shaft A is also formed over smaller-diameter step regions with a hollow e that is open at that tip end side.

Figure 5:
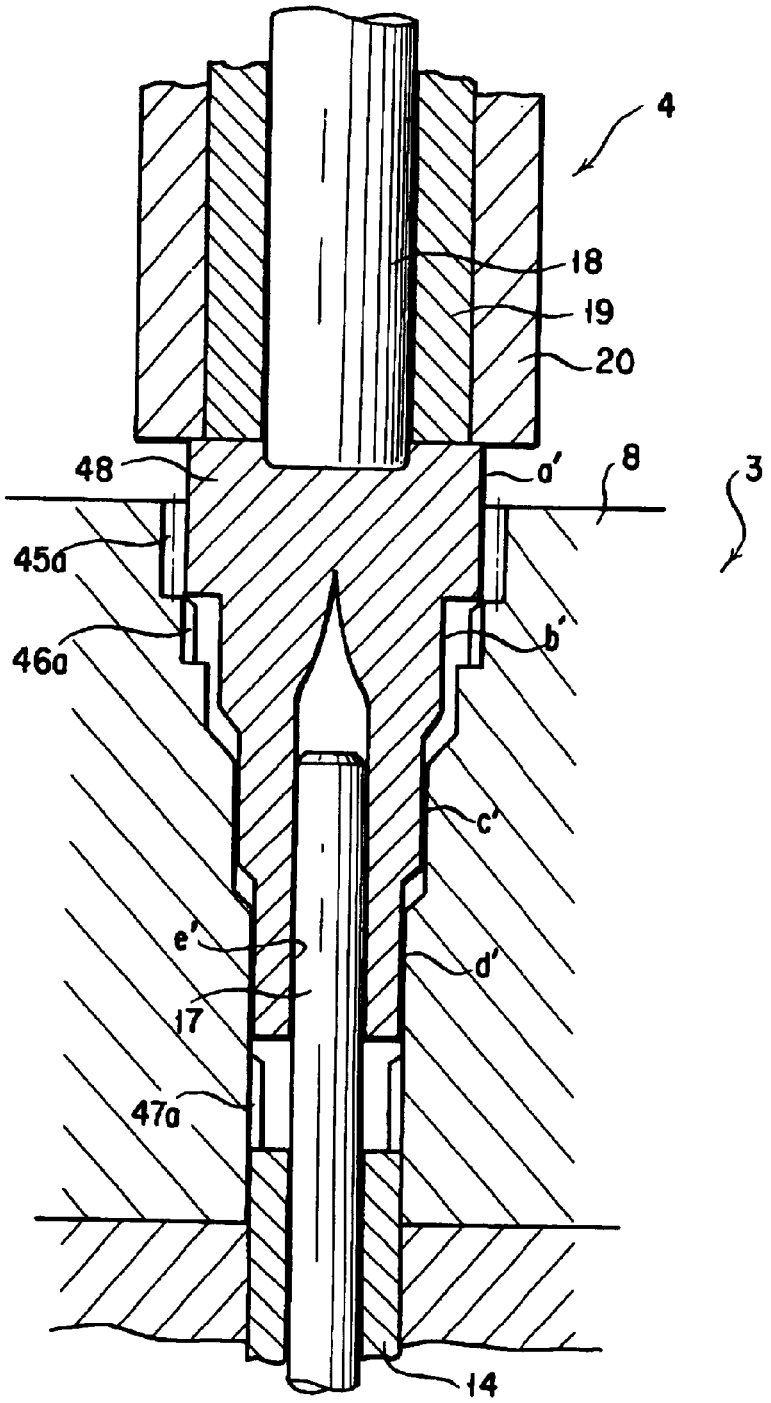
FIG. 5 is a cross sectional view illustrating a forming material loaded in a lower die set.

FIG. 5 shows a state that a forming material 48 is loaded into the lower die 8 in the lower die unit 3. The lower die 8 is here formed with a forming die cavity configured to form the above-mentioned stepped shaft A and has its inner surface provided with forming die sections 45*a,* 46*a* and 47*a* which correspond to the gear 45 and the first and second splines 46 and 47, respectively, in the stepped shaft A. On the other hand, the forming material 48 has been adapted so as to be loadable into the abovementioned forming die cavity and has been preformed in a blank forming stage with contours generally corresponding to those of the stepped shaft A. The preformed forming material 48 is thus shaped to have step regions a', b', c' and d' which correspond to the step regions a, b, c and d, and further a hollow e' corresponding to the hollow e in the stepped shaft A. And, the material 48 is seen to have a portion of its first step region a' projecting from the forming die cavity by a certain height. It is also seen that a hollow forming pin 17 is inserted into the hollow e' by a predetermined depth.

Figure 6:
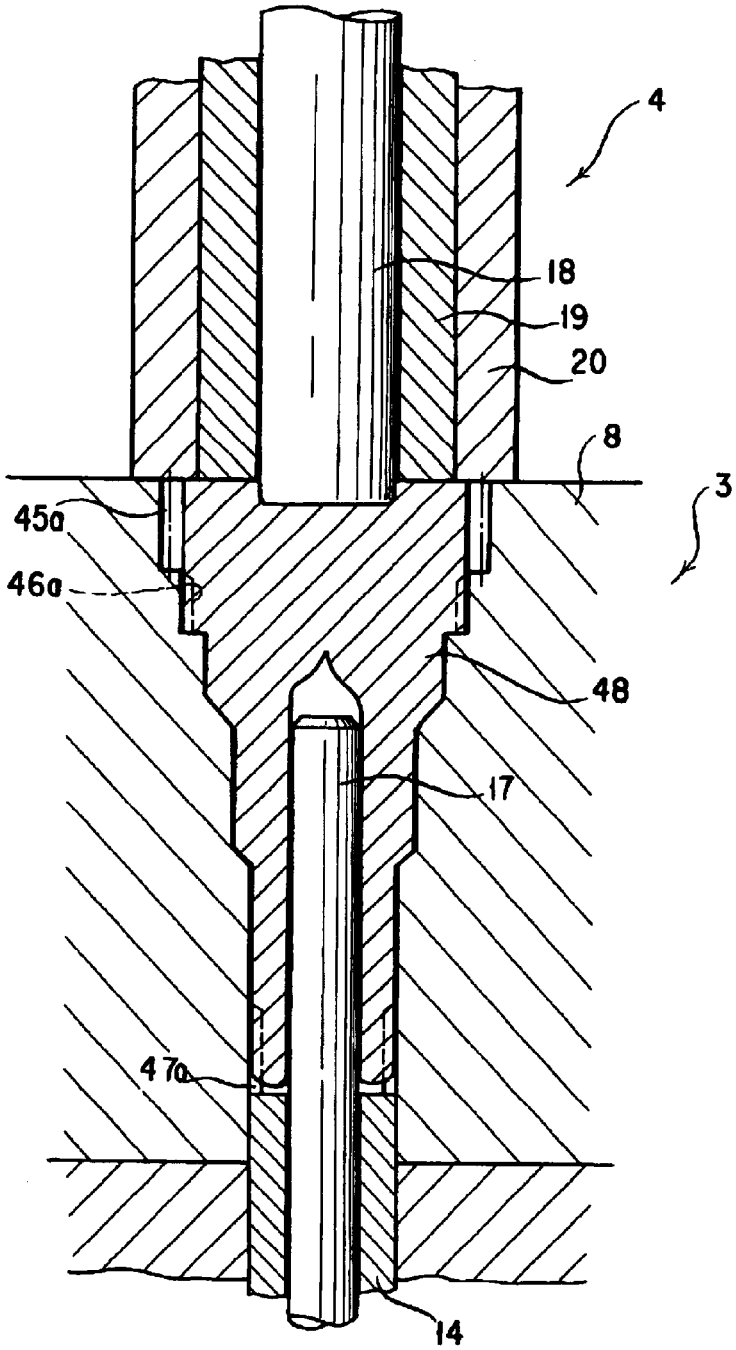
FIG. 6 is a cross sectional view illustrating a first forming step.

FIG. 6 shows a first forming step in which with both the inner and outer cylinders 24 and 26 deactuated and with only the main cylinder 30 actuated, the upper die unit 4 are moved down to press the end face of the first step region of the formable material 48 with the punches 18, 19 and 20 acting thereon as a body.

The formable material 48 is thus forced into the forming die cavity in this step whereby the first and fourth step regions a' and d' are extruded to enter the first and second spline forming die sections 46*a* and 47*a,* respectively, to form the first and second splines 46 and 47 in these step regions, respectively. The first forming step is thereby completed.

In this case, the inner and outer punches 19 and 20 are adjusted in initial position relative to the main punch 18 so that a suitable relationship between them in position is established that meets the forming requirement mentioned above. The initial positions of the inner and outer punches 19 and 20 correspond to the most advanced ends of the inner and outer cylinders 24 and 26, respectively.

The completion of the first forming step is detected by the slide position detector 40 that is responsive to the stroke of the slide 2. Here, note that the lower part forming cylinder 27 lies at its lower limit position. It should also be noted that the inner and outer punches 18 and 19 upon touching the upper surface of the lower die 8 make their inner spaces closed tightly.

Figure 7:
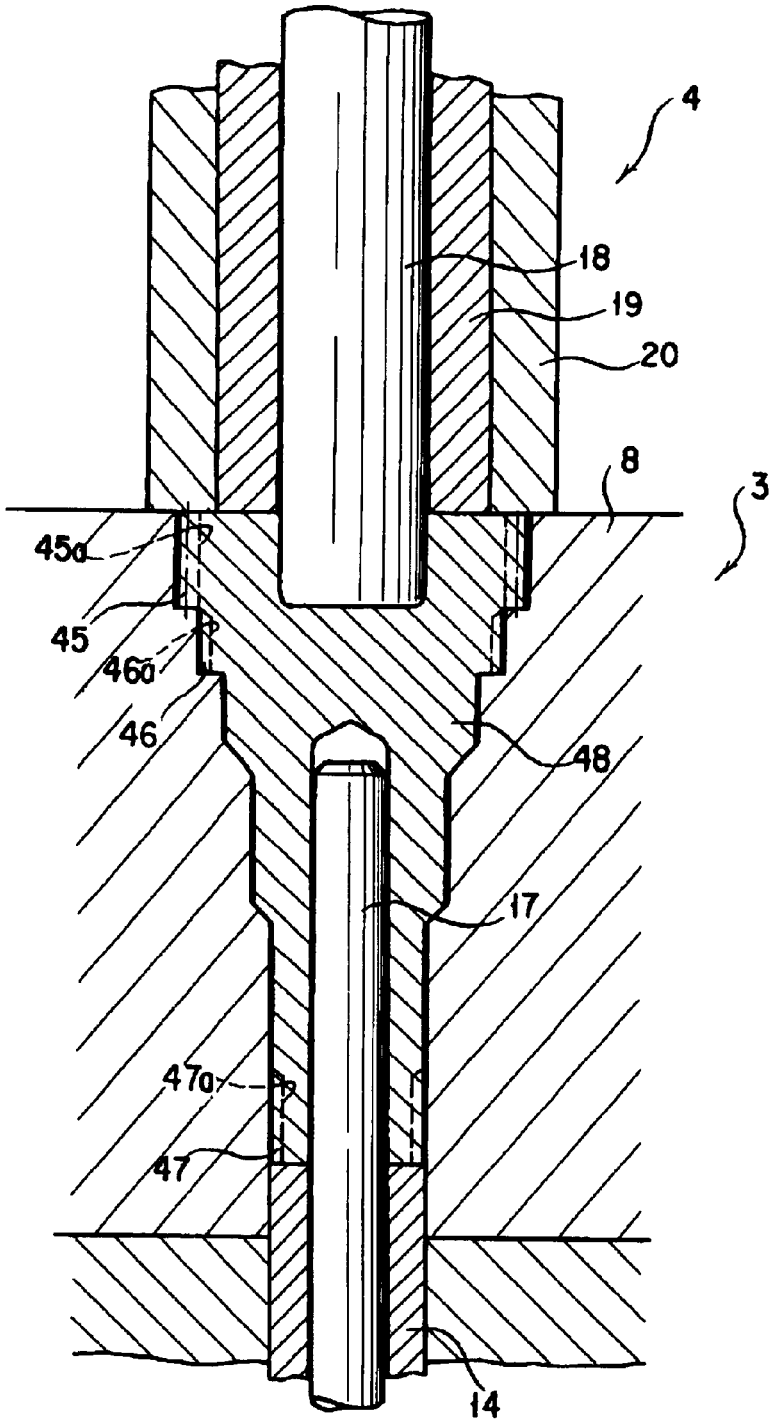
FIG. 7 is a cross sectional view illustrating a second forming step.

Referring next to FIG. 7, a second forming step is shown. Here, only the main punch 18 from the state that the first forming step has been completed is moved down to press only the first step region a' axially. This causes the first step region a' to expand in diameter radially outwards perpendicular to its axis so that an outer incremental portion thereof comes into the gear die section 45*a* where the step region a' is roughly formed with a gear 45.

In this stage, the main punch 18 in the upper die unit 4 is moved down as one with the slide 4 that is moved down by the main cylinder 30 which is actuated. On the other hand, while the inner and outer punches 19 and 20 are also moved down together with the slide 2, they are moved up by the actuation of the inner and outer cylinders 24 and 26, respectively, at the same speed and over the same distance which the main punch 18 is moved down by the main cylinder 30 so that both the punches 19 and 20 are kept standstill at the position which they have reached at the end of the first forming step. Consequently, the punches 19 and 20 stay holding the upper end of the forming material 48 with their lower end faces.

Also in this stage, the lower part forming die 14 which is supported from the set pedestal 9 may as needed be moved up to assist forming the tip end portion of the stepped shaft A by actuating the lower part forming cylinder 27 to move the lower supporting block 16 upwards.

Figure 8:
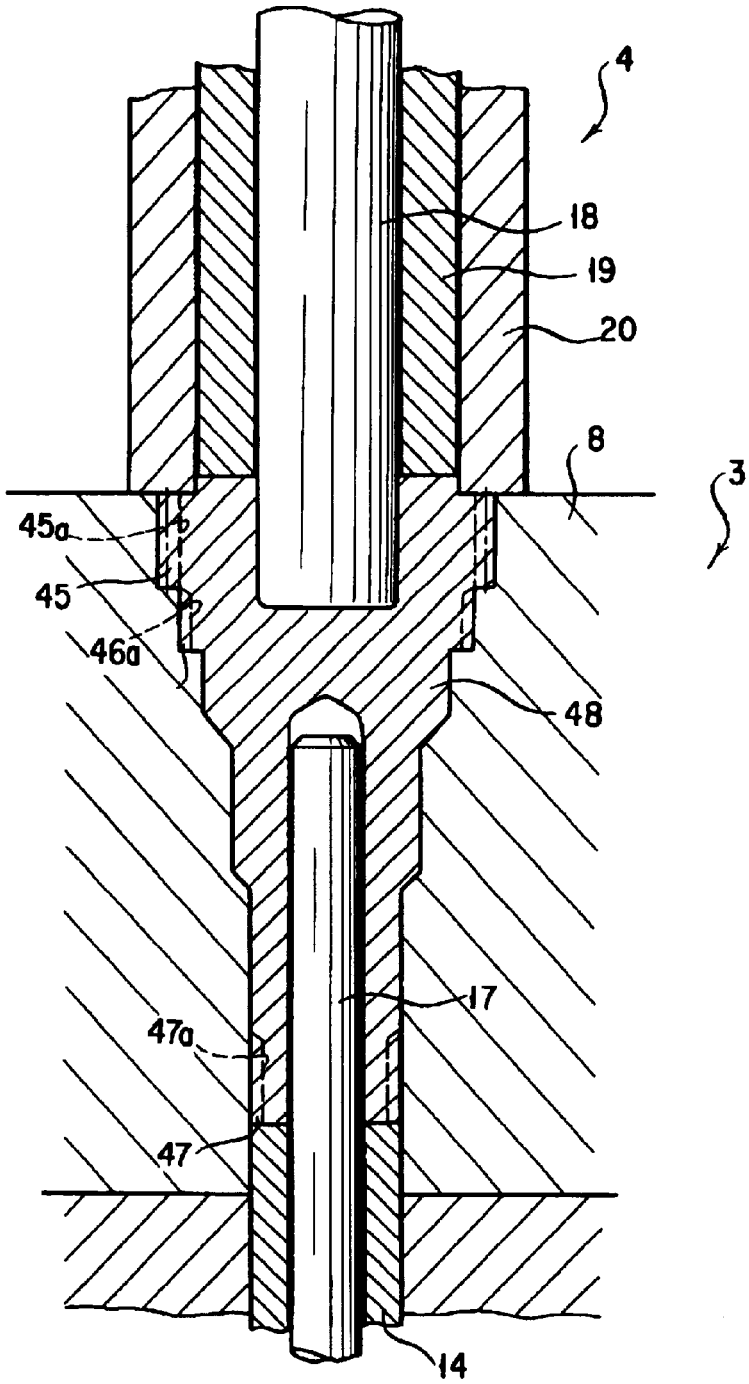
FIG. 8 is a cross sectional view illustrating a third forming step.

FIG. 8 illustrates a third forming step. Here, the main punch 18 is further moved down from its position of the second forming step to finish-form the gear 45. Here again, the outer punch 20 is moved up at the same speed and over the same distance which the main punch 18 is moved down so that substantially it is kept standstill. The inner punch 19 is held in a back pressure regulated state by lowering the pressure in the inner cylinder 24. The inner punch 19 thus stays holding a portion of the upper end of the forming material 48. Applied to this portion, a force that exceeds a certain limit is free to push the inner punch 19 to move upwards while forcing the forming material 48 partially to flow upwards, thereby forming a raised extra area.

Figure 9:
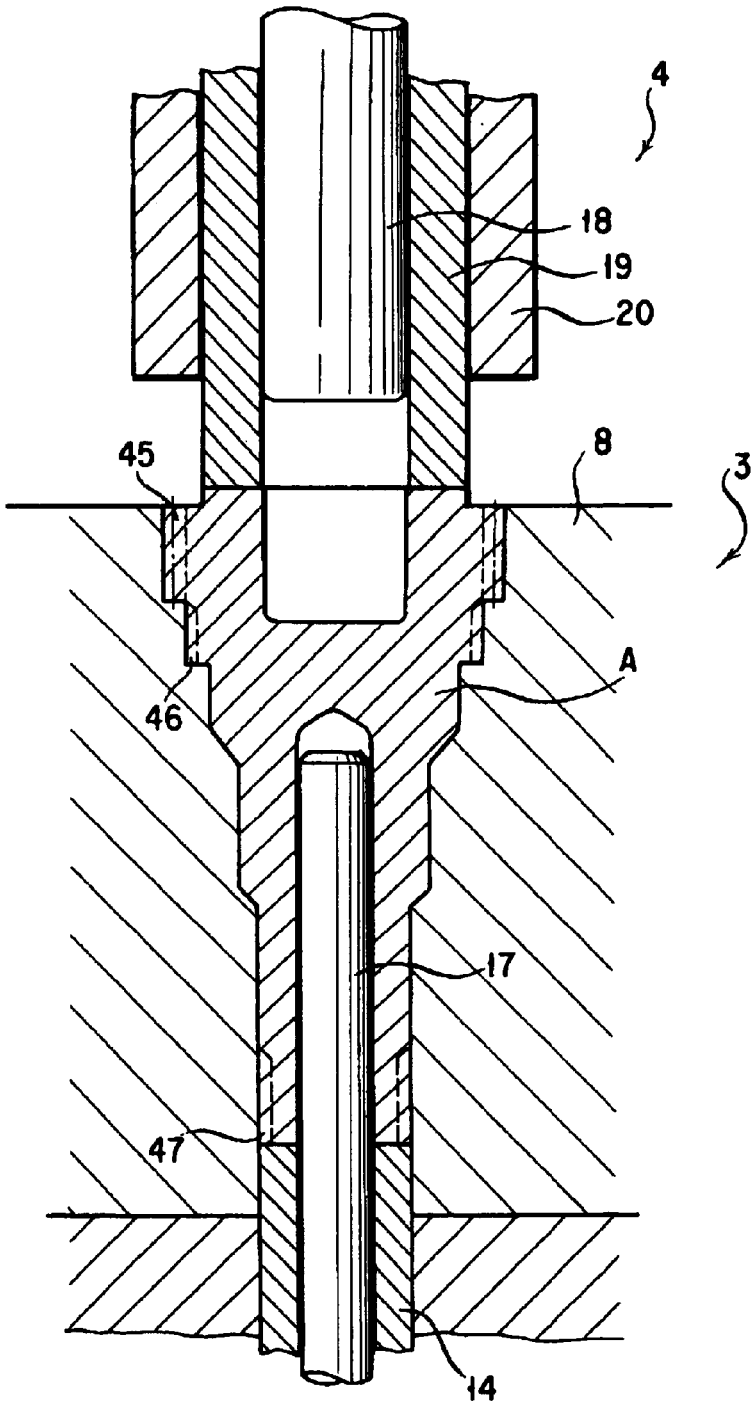
FIG. 9 is a cross sectional view illustrating a fourth forming step.

FIG. 9 illustrates a fourth forming step. Here, the inner punch 19 as a stripper is left at the position of the third step, and the main and outer punches 18 and 20 are moved upwards.

This fourth step completes the forming operation. The upper die unit 4 is moved up, after which the lower supporting block 16 is raised to knock out the formed product. Here, the gear 45 if it is a straight gear is knocked out as it is, but the formed product if it is a helical gear is knocked out while being rotated along its gear teeth.

In a double action oil hydraulic press according to the present invention, cylinders' operations are controlled by controlling in combination the speed of rotation of the oil hydraulic pump and the servo and proportional valves so that their positioning and lower dead point control are effected accurately and in an unload state the pump discharge flow is reduced to an extent not to hinder its lubrication. Also, since the flow of operating oil fed into each cylinder is controlled by its associated servo or proportional valve, the discharge from the variable displacement pump 52 can be reduced according to the supply rate of oil into a cylinder to be actuated, thus making it possible to reduce the necessary loading of operating oil, e.g., to 700 liters, which can in turn reduce the capacity of the reservoir. That is, thanks to the fact that the five types of cylinders mostly are not driven concurrently at any given period of time, namely the main cylinder alone driven until a forming start position is reached, the main cylinder alone driven in the initial stage of forming, only the main, inner and outer cylinders driven in the middle stage of forming and only the lower part forming cylinder alone driven in the final stage of forming.

Further, since the amount of operating oil that need be used can be reduced as mentioned above, it is avoided for a large quantity of operating oil to be drained through the relief valve and it is possible to control the heating of operating oil and thus to reduce the loss of energy.

The main cylinder 30 is supplied with oil at a flow rate that is determined by a rate of rotation of the pump controlled by the inverter motor so that the pressure exerting slide 2 is moved down at a controlled speed. And, the final positioning of the slide 2 to halt is controlled jointly with the servo valve 34 which controls the flow rate of pressure oil supplied from the power unit 31 Then, the pressing speed of the slide 2 may be 3 to 25 mm/sec where the slide 2 can be brought to halt at a halting precision of ±0.05 mm or less, which is much better than the conventional inaccuracy of 0.1 mm.

In the 5-axis double action oil hydraulic press mentioned above, the three upper cylinders and the two lower cylinders can individually be controlled in speed, time, position and pressure, respectively. Also, a die apparatus is provided having the 5-axis double action oil hydraulic press integrated therewith, of which a die makeup part can be placed under control of the cylinders mentioned above to control its position, backpressure or closure in a preestablished mode and to perform a forming operation in a grain flow optimum mode. Moreover, the ability to control within limits of forming leads to a sharp reduction of the forming time period of each of the successive forming steps. Further, provided with the ability to perform a modeling and to display and store forming conditions through a personal computer, the apparatus is extremely convenient.

Although the present invention has hereinbefore been set forth with respect to certain illustrative embodiments thereof, it will readily be appreciated to be obvious to those skilled in the art that many alterations thereof, omissions therefrom and additions thereto can be made without departing from the essences of scope of the present invention. Accordingly, it should be understood that the invention is not intended to be limited to the specific embodiments thereof set forth above, but to include all possible embodiments that can be made within the scope with respect to the features specifically set forth in the appended claims and to encompass all the equivalents thereof.

What is claimed is:

1. A double action oil hydraulic press having a main cylinder for actuating a slide and a lower part forming cylinder for actuating a lower part forming unit, said hydraulic press comprising:

a power unit comprising a variable displacement oil hydraulic pump and an inverter motor for driving said variable displacement oil hydraulic pump;

controllable servo valves respectively provided in hydraulic circuits connecting said power unit to said main cylinder and to said lower part forming cylinder;

servo controllers for respectively controlling said servo valves;

cylinder pressure detecting sensors respectively provided in said hydraulic circuits;

position detecting sensors for sensing positions of said slide and said lower part forming unit, respectively;

a control unit for providing said inverter motor in said power unit and said servo controllers with respective control signal, and means for feeding respective sensing signals of said cylinder pressure detecting sensors and said position detecting sensors to said control unit.

2. A double action oil hydraulic press having a main cylinder for actuating a slide, an inner and at least one outer cylinder provided in the slide and a lower part forming cylinder for actuating a lower part forming unit, said hydraulic press comprising:

a power unit comprising a variable displacement oil hydraulic pump and an inverter motor for driving said variable displacement oil hydraulic pump;

controllable servo valves respectively provided in hydraulic circuits connecting said power unit to said main cylinder and to said lower part forming cylinder;

servo controllers for respectively controlling said controllable servo valves;

controllable proportional valves respectively provided in hydraulic circuits connecting said power unit to said inner cylinder and to said outer cylinder;

proportional valve controllers for controlling said controllable proportional valves;

cylinder pressure detecting sensors respectively provided in said hydraulic circuits connecting said power unit to said main cylinder, to said lower part forming cylinder, to said inner cylinder and to said outer cylinder;

position detecting sensors for sensing positions of said slide and said lower part forming unit, respectively;

a control unit for providing said inverter motor in said power unit, said servo controllers and said proportional valve controllers with respective control signals, and means for feeding respective sensing signals of said cylinder pressure detecting sensors and said position detecting sensors to said control unit.

* * * * *